US011084608B2

(12) United States Patent
Newcombe et al.

(10) Patent No.: US 11,084,608 B2
(45) Date of Patent: Aug. 10, 2021

(54) FLOW WRAPPER APPARATUS WITH FORMING TUBE

(71) Applicants: MODA IP LIMITED, Auckland (NZ); Richard Guyon Newcombe, Auckland (NZ); Alexander Richard Melville, Auckland (NZ); Daniel Noakes, Auckland (NZ); Hayden Wright, Auckland (NZ); Thomas Frietsch, Auckland (NZ); Ryan Donovan, Auckland (NZ)

(72) Inventors: Richard Guyon Newcombe, Auckland (NZ); Alexander Richard Melville, Auckland (NZ); Daniel Noakes, Auckland (NZ); Hayden Wright, Auckland (NZ); Thomas Frietsch, Auckland (NZ); Ryan Donovan, Auckland (NZ)

(73) Assignee: MODA IP LIMITED, Auckland (NZ)

( * ) Notice: Subject to any disclaimer, the term of this patent is extended or adjusted under 35 U.S.C. 154(b) by 77 days.

(21) Appl. No.: 16/099,111

(22) PCT Filed: Apr. 25, 2017

(86) PCT No.: PCT/NZ2017/050046
§ 371 (c)(1),
(2) Date: Nov. 5, 2018

(87) PCT Pub. No.: WO2017/192050
PCT Pub. Date: Nov. 9, 2017

(65) Prior Publication Data

US 2019/0144148 A1 May 16, 2019

(30) Foreign Application Priority Data

May 5, 2016 (NZ) ..... 719808

(51) Int. Cl.
*B65B 9/22* (2006.01)
*B65B 25/06* (2006.01)
*B65B 9/207* (2012.01)

(52) U.S. Cl.
CPC ..... *B65B 9/22* (2013.01); *B65B 9/207* (2013.01); *B65B 25/065* (2013.01); *B65B 2220/08* (2013.01)

(58) Field of Classification Search
CPC .. B65B 9/22; B65B 9/207; B65B 9/20; B65B 25/065; B65B 2220/08; B29C 66/49; B29C 66/4322
(Continued)

(56) References Cited

U.S. PATENT DOCUMENTS 3,155,018 A * 11/1964 Rolf ..... B29C 53/52 493/468
3,274,746 A * 9/1966 James ..... B65B 9/06 53/433
(Continued)

FOREIGN PATENT DOCUMENTS

EP 0 119 957 A1 9/1984
EP 2258627 A1 12/2010

OTHER PUBLICATIONS

International Search Report and Written Opinion, dated Jul. 3, 2017, from corresponding PCT application No. PCT/NZ2017/050046.

*Primary Examiner* — Dariush Seif
(74) *Attorney, Agent, or Firm* — Nixon & Vanderhye

(57) ABSTRACT

A form-fill-seal packing apparatus of the flow wrapper type accepts individuated items via in-feed conveyor. Items are moved through horizontal open lower-sided forming tube 10 by resting indirectly on an underneath transit conveyor, through the underside part of a continuous film bag forming from a supply of film around the forming tube, using a forming shoulder. The bag is longitudinally sealed beside the
(Continued)

forming tube. Data may be printed on an upper film surface over a platen including an upper part of the forming tube. An outfeed conveyor carries transversely sealed wrapped items on to a vacuum sealer.

8 Claims, 5 Drawing Sheets

(58) Field of Classification Search
USPC ..... 53/550, 450, 552; 493/302, 308
See application file for complete search history.

(56) References Cited

U.S. PATENT DOCUMENTS 3,415,171 A * 12/1968 Wilson ..... B65B 59/001 493/302
3,431,831 A * 3/1969 Hardee ..... B65B 9/06 493/302
3,935,048 A * 1/1976 Rucker ..... B29C 53/52 156/203
3,948,150 A * 4/1976 Hobart ..... B65B 9/22 493/468
4,194,438 A * 3/1980 Schmachtel ..... B65B 9/2028 493/274
4,479,283 A * 10/1984 Hollingsworth ... A22C 13/0003 452/22
4,490,962 A * 1/1985 Weis ..... B29C 65/18 53/550
4,563,231 A * 1/1986 Porrmann ..... B29C 66/72341 156/90
4,587,794 A 5/1986 Kopp
4,589,145 A * 5/1986 Van Erden ..... B65B 9/067 383/204
4,658,569 A * 4/1987 Hanagata ..... B65B 9/073 53/389.2
4,663,915 A * 5/1987 Van Erden ..... B65B 9/073 493/214
4,761,937 A * 8/1988 Francioni ..... B65B 9/06 53/450
4,872,302 A * 10/1989 van Eijsden ..... B65B 53/00 53/441
4,874,257 A * 10/1989 Inagaki ..... B65B 9/20 383/63
4,909,017 A * 3/1990 McMahon ..... B65B 61/188 156/66
4,941,307 A * 7/1990 Wojcik ..... B65B 9/073 383/61.2
5,111,643 A * 5/1992 Hobock ..... B65B 9/20 53/139.2
5,165,221 A * 11/1992 Udelson ..... B65B 9/06 493/302
5,255,495 A * 10/1993 Kovacs ..... B65B 59/02 53/504
5,417,035 A * 5/1995 English ..... B65B 9/20 383/200
5,417,041 A 5/1995 Hansen et al.
5,448,758 A 9/1995 Grube et al.
5,768,861 A * 6/1998 Slenders ..... B65B 9/2028 53/551
5,987,860 A * 11/1999 Yang ..... B65B 9/067 493/302
6,131,369 A * 10/2000 Ausnit ..... B65B 9/20 493/213
6,185,907 B1 2/2001 Malin et al.
6,599,389 B1 * 7/2003 Uneda ..... B29C 53/52 156/379.8
6,662,527 B1 * 12/2003 Suga ..... B29C 65/18 53/374.6
6,845,602 B2 * 1/2005 Drut ..... B29C 53/52 53/550
8,464,502 B2 6/2013 Spiekers et al.
9,038,355 B2 * 5/2015 Honegger ..... B65B 59/003 53/492
9,662,852 B2 * 5/2017 Nagata ..... B31B 70/64
10,631,465 B2 * 4/2020 Actis ..... B65B 35/10
2003/0163979 A1 * 9/2003 Kurth ..... B65B 9/22 53/551
2004/0083685 A1 * 5/2004 Knoerzer ..... B65B 9/2028 53/412
2004/0173492 A1 * 9/2004 Kane, Jr. ..... B65B 61/188 206/494
2005/0016131 A1 * 1/2005 Laplace ..... B65B 25/068 53/451
2005/0044822 A1 * 3/2005 Braun ..... B65B 59/003 53/551
2006/0130435 A1 * 6/2006 Hada ..... B65B 61/02 53/450
2006/0179798 A1 * 8/2006 Thorpe ..... B65B 9/073 53/550
2007/0163214 A1 * 7/2007 Hauers ..... B65B 9/2049 53/551
2008/0047232 A1 * 2/2008 Kovacs ..... B65B 25/145 53/450
2009/0229226 A1 * 9/2009 Beeland ..... B65B 27/125 53/450
2013/0097966 A1 * 4/2013 Honegger ..... B29C 65/7894 53/204
2013/0097976 A1 * 4/2013 Honegger ..... B65B 59/001 53/492
2013/0209005 A1 * 8/2013 Owensby ..... B65B 9/08 383/210.1
2014/0318081 A1 10/2014 Knöpfel
2016/0288937 A1 10/2016 Grether et al.

* cited by examiner

FLOW WRAPPER APPARATUS WITH FORMING TUBE

FIELD

The present invention relates to packaging methods and apparatus; to machinery and methods for enclosing successive articles, items or quantities of material in a film continuously folded into a tube surrounding each of the articles placed upon it; then sealed. In particular, the invention relates to meat packing apparatus of the flow wrapper type, having both continuous and intermittent motion of the film.

DEFINITIONS

"Film" is a packaging industry term used herein to refer to the shrink-wrap, sealable plastics barrier film used for packaging items of meat. Many types of multilayer shrink barrier films are readily available in the market. The film may have more than one layer, and the layers may be of different plastics materials. A typical cost is about 35-40 US cents per square metre.

BACKGROUND TO THE INVENTION

Packed meat, particularly meat sealed within a barrier film and either with a controlled atmosphere or in a vacuum has a prolonged shelf life during transport, storage and display.

A seal helps to maintain a controlled atmosphere or vacuum within the bag made on-site out of a film; such as an inert or preservative gas (modified atmosphere packaging or MAP). Some film materials do not allow diffusion of gas A packaging system is not fit for its purpose if there is a risk of leakage, or actual leakage, through the barrier film or seals into the packaged produce or out of the produce, causing sanitation and public health issues.

Packaging is particularly relevant in meat packing especially if bagged product is held for a period of time or is shipped over long distances. It is usual in meat packing apparatus to take a manufactured flat film or a pre-shaped tube of barrier film and configure the film into one of: (a) a continuous bag with the product inside; (b) a bag sealed at one end so that a vacuum may be pulled in a later step, before also sealing the bag at the other end, or (c) a bag sealed at both ends and including a modified atmosphere.

Bag-forming packaging involving forming tubes are known but most operate vertically. Because a cut of meat inside a vertical forming tube will slump under gravity and become deformed if packed vertically, horizontal operation is desired.

Typical existing flow wrapper apparatus is of a type known as form-fill-seal, meaning that the film is formed into a shape to create a pouch for the product and at about the same time the product is placed inside the pocket. The bagged product is then evacuated and sealed.

Some existing apparatus folds a flat sheet of film around the product. Then, a median longitudinal seal is made down a wide surface to enclose the product inside a sealed tube. "Median" as used herein means down the middle, rather than down a side of a the finished bag. Thereafter, transverse seals are then made at one or both ends of the bag, to form a pouch holding an item that is ready for passing onto a vacuum apparatus that makes the final enclosing seal. Median seals are unsightly and make printing over an entire top, or bottom surface difficult. Some food safety regulations require spaces to be maintained between a seal and printed material, further reducing the surface area available for printing.

Bag printing is intended to record product description on an item-by-item basis. In the food packaging industry, printed data requirements are becoming ever more detailed, yet full compliance is required. Accurate descriptions including batch numbers packing dates, country of origin, and supplier branding are often required. The printed indicia may include precise descriptions of the origin and nature each cut of meat or other item that is being bagged for customer appreciation purposes. The film may be pre-printed with supplier or retailer brands.

Another disadvantage of present apparatus is that where a transverse seal and a median longitudinal seal meet, leaks are known to be likely. The median seal comprises two abutting films, first sealed as shown in prior art FIG. 6*a* and laid over as shown in FIG. 6*b*. If the transverse seal crosses the earlier-made median seal, the extra thickness detracts from sealing quality since there are twice as many layers of film to be heated to a fusing temperature and pressed together.

A further issue, particularly in the meat packaging industry is that the cuts of meat to be packaged can vary in size considerably. An extra margin for sealing is provided at a distance from the meat cut (as compared to other items) because a stray piece of meat or a small amount of leaked liquid may contaminate the film before sealing and prevent film-to-film fusion at the seal. Some prior art machines always made a bag or pouch size large enough to accommodate the largest anticipated meat cut size, plus a margin. Significant film wastage can be a result, especially when smaller meat cuts are packed. Cuts arrive at the flow wrapper machine in any order of size.

PRIOR ART

US2016/0288937 Grether et al describes a tubular bag forming machine adding an atmosphere inside the bag. The longitudinal seal is median.

U.S. Pat. No. 5,417,041 describes side sealing.

U.S. Pat. No. 6,185,907 describes an asymmetrical forming shoulder or plough capable of folding a film in strip form into an enclosing tube in a horizontal form fill and seal machine, and of welding the free edges together. It adds a plastic interlocking zipper.

U.S. Pat. No. 5,448,758 describes monitoring the article size. None of the prior art describes forming tube construction and advantages thereof.

OBJECT

It is an object of the present invention to provide an improved packing method and apparatus that goes at least some way to alleviating at least one of the disadvantages above, or at least to provide a useful alternative choice.

SUMMARY OF THE INVENTION

According to a first aspect the invention broadly comprises flow wrapper apparatus with a forming tube (1) using at least one plastics film for bagging each item (15) of a series of items received from an adjacent in-feed conveyor (9); wherein the apparatus has a forming tube (10) having a length, a near side, a far side, an in-feed end (25), an internal space, and an out-feed end, the forming tube is disposed when in use in a substantially horizontal processing direction and has a upper surface flattened at least in part, and the lower surface of the forming tube comprises a downwardly disposed, broad, continuous, elongated lower aperture (12) opening into the internal cavity.

In a related aspect, the forming tube has a rounded transverse cross-section including rounded edges of the downwardly directed open side, and any transverse cross-section of the forming tube resembles a letter "C" having a downwardly directed open side.

Preferably an upper portion of the forming tube is configured as a flat printing platen (13) located underneath and in sliding contact with the film of the second side; the platen, when in use, defining a surface for use by printing means.

In a related aspect, the lower aperture (12) is, when in use, disposed above, and not in contact with, and parallel to an axis of movement of an endless transit conveyor (5) having an upwardly directed contact surface capable when in use of motion at a controlled speed parallel to and underneath the forming tube (10) in a direction from an in-feed end to an out-feed end.

Preferably the forming tube (10) of the flow wrapper apparatus is combined with a shaped asymmetric forming shoulder (11) comprising a shaped surface adapted to guide film supplied from a spool (2) situated perpendicular to the length of the forming tube and partially to one side of the forming tube through supply rollers (3) to slide into a position in relation to the forming tube wherein film originating from a first side of the spool covers the lower aperture (12) of the forming tube; film originating from a second side of the spool is folded over the far side of the forming tube to cover the upper side of the forming tube, and a first free edge of the film of the first side is aligned with and adjacent a second free edge of the film of the second side along and outside the near side of the forming tube.

Preferably each forming tube (10) of the flow wrapper apparatus, when combined with a shaped asymmetric forming shoulder (11) comprises a forming set.

Preferably the forming shoulder (11) of the set is disposed, when in use, adjacent and to one side of a median of a supply roll (2) of film; the forming shoulder serving when in use as a slidable surface to lead a first side, having a free edge, of a length of the film adjacent the surface of the transit conveyor (5) and to slidably enclose the lower side of the forming tube (10), and of leading a second side of the length of the film, also having a free edge, behind a forming tube support means and folding the second side over and on to the upper surface of the forming tube, thereby enclosing the forming tube in sliding contact; the folded film thereby having both free edges directed toward an operator side of the forming tube.

Preferably the apparatus includes first film transport means including a frictional connection (5A) made between the contact surface of the transit conveyor (5) and a first part of the film (17) slidably enclosing the lower aperture (12) of the forming tube (10), using friction produced between a contact surface of the transit conveyor (5) and the film underneath each item (15) of a series of items within the forming tube (10) as a consequence of a weight of each item resting indirectly through the film upon the contact surface, so that, when in use, motion of the transit conveyor draws the film over the forming shoulder (11) and draws the film and the series of items and along the length of the forming tube.

Preferably the apparatus includes second film transport means located along the near side of the forming tube (10); the transport means comprising a gripping set of transport devices (6) selected from a range of pinch wheels, pinch rollers and pinch belts driven by at least one motor turning at a controlled speed thereby complementing the film transport force exerted against the contact surface of the transit conveyor (5) when causing the film to enclose the forming tube that in turn encloses each item to be bagged.

In a related aspect the driven surfaces of the second film transport means are moved at a velocity that is maintained in step with the velocity of motion of the contact surface of the transit conveyor by servo control means.

In a further related aspect, the driven surfaces have a narrow profile and are selected from a range including drive belts or drive wheels or a caterpillar drive.

In a subsidiary aspect, the second film transport means is adjacent film sealing means (4) selected from a range including heated wheels, heated rollers, ultrasonic sealers, and hot gas, capable when in use of sealing together the two free edges of the film when adjacent and outside the forming tube, thereby making a longitudinal seal along the film.

Preferably the free edges of the film before and during passage through the side edge sealing station are shielded from contamination by the or each item to be bagged.

Preferably the forming tube (10) and the associated forming shoulder (11) are held in place by forming tube support means (10A) extending from at least one hinged mount disposed toward the inaccessible side of the forming tube and fixed to a frame of the bagging machine.

Optionally the forming tube (10) and the associated forming shoulder (11) are removable and replaceable with a differently sized and/or shaped tube and shoulder, in order to provide an ability to pack items having a variety of size ranges within film of appropriate widths.

Preferably the apparatus includes a transversely disposed bag sealing device (7) includes a knife and a transversely oriented film sealing means.

Optionally the transversely disposed bag sealing device (7) further includes a second transversely oriented film sealing means wherein the second sealing means is adapted to provide a sealing heat at separated points only, thereby providing a gas-permeable tack seal.

In a second broad aspect, the apparatus is produced in a left-to-right operating mode, or in a right-to-left operating mode.

In one option said bag termination device is supported on a movable support and is capable of moving along the axis of the forming tube in step with motion of the transit conveyor when carrying out bag sealing and bag cutting.

In an alternative option the transit conveyor is stopped when the bag termination device is in operation.

Preferably the flow wrapper bagging apparatus is provided with sensors capable when in use of monitoring a supply of items to be bagged and measuring each item in length while in transit upon a conveyor and of controlling timing of operation of the bag termination device in order that each item is fully enclosable in an optimal amount of plastic.

PREFERRED EMBODIMENT

The description of the invention to be provided herein is given purely by way of example and is not to be taken in any way as limiting the scope or extent of the invention. The invention has been described in an illustrative manner, and it is to be understood that the terminology which has been used is intended to be in the nature of words of description rather than of limitation. Further, the description relates to the improvements and is not intended to describe the conventional apparatus in detail. Terms such as "horizontal", underside, and "above" are not to be understood as limiting, although the apparatus described preferably operates with a substantially horizontal transport axis.

Throughout this specification unless the text requires otherwise, the word "comprise" and variations such as "comprising" or "comprises" will be understood to imply the inclusion of a stated integer or step or group of integers or steps but not the exclusion of any other integer or step or group of integers or steps. Each document, reference, patent application or patent cited in this text is expressly incorporated herein in their entirety by reference. Reference to cited material or information cited in the text should not be understood as a concession that the material or information was part of the common general knowledge or was known in New Zealand or in any other country.

BRIEF DESCRIPTION OF THE DRAWINGS

Preferred embodiments of the invention will be described by way of example only and with reference to the drawings, in which.

DETAILED DESCRIPTION

The invention has been developed as part of a meat or fish packaging process, although it is intended that the method and apparatus may also be applicable to other types of packaging. The 195 version of the flow wrapper as described in the specification and drawings has since been enhanced with more instrumentation and servo motors for process control, and hinged mounts for internal access for cleaning and maintenance purposes, while retaining the inventive aspects as described.

Example 1

Figure 1:
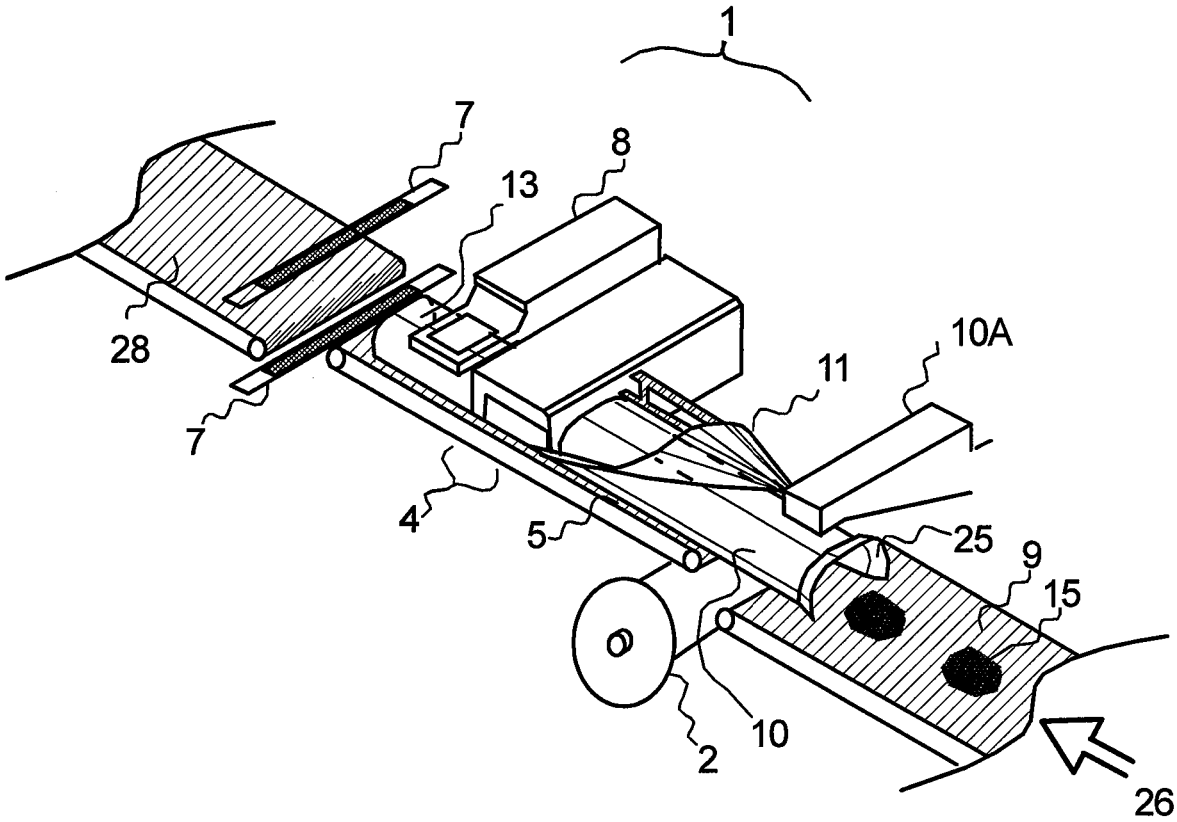
FIG. 1 is a diagrammatic perspective view to show the essentials of a right-to-left flow wrapper packaging apparatus, from the operator station side.
Figure 5:
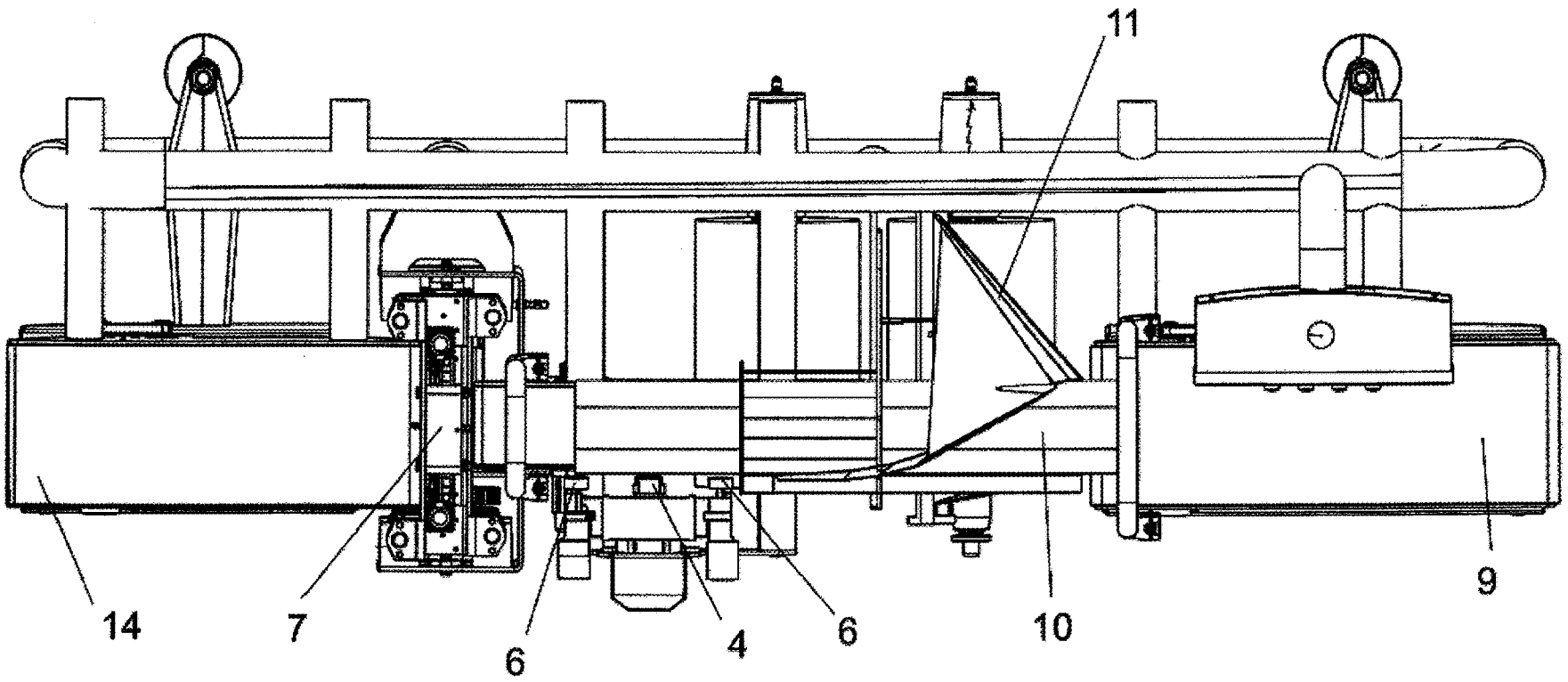
FIG. 5 is a top (plan) view of the apparatus of FIG. 2.

With reference to FIG. 1, an example horizontal form-fill-seal packing apparatus 1 of the flow wrapper type is shown in a diagrammatic perspective view. Assorted or sorted items to be packed 15 are brought to the apparatus in a flow direction 26 via in-feed conveyor 9 (hatched) on to which they were placed by hand or by machine and are preferably individuated. They pass through the forming tube 10, around the outside of which a continuous film bag is formed from a supply spool 2 of film, with assistance of a forming shoulder 11, and longitudinally sealed in the region indicated by 4 (see FIG. 5). Forming tube 10 is supported on bracket 10A. No chassis or frame is shown. Items are moved through forming tube 10 by an upper contact surface of transit conveyor 5 along with the film, using frictional contact through the open side of the forming tube as a linkage between the conveyor and the items. During passage, a printing head located on rear-mounted support 8 may print desired information on to an upper part of the film, using part of the forming tube as a platen 13 under the film. For fast replenishment of film, it is preferred that a second supply spool of film is also held in place. The output, carried on outfeed conveyor 28 comprises a series of wrapped items. For the present Example, the bag is partly sealed at 7,7 but will not be fully sealed until during a subsequent vacuum sealing process, and that is followed by a shrinking process; both latter processes being beyond the scope of this document.

Figure 2:
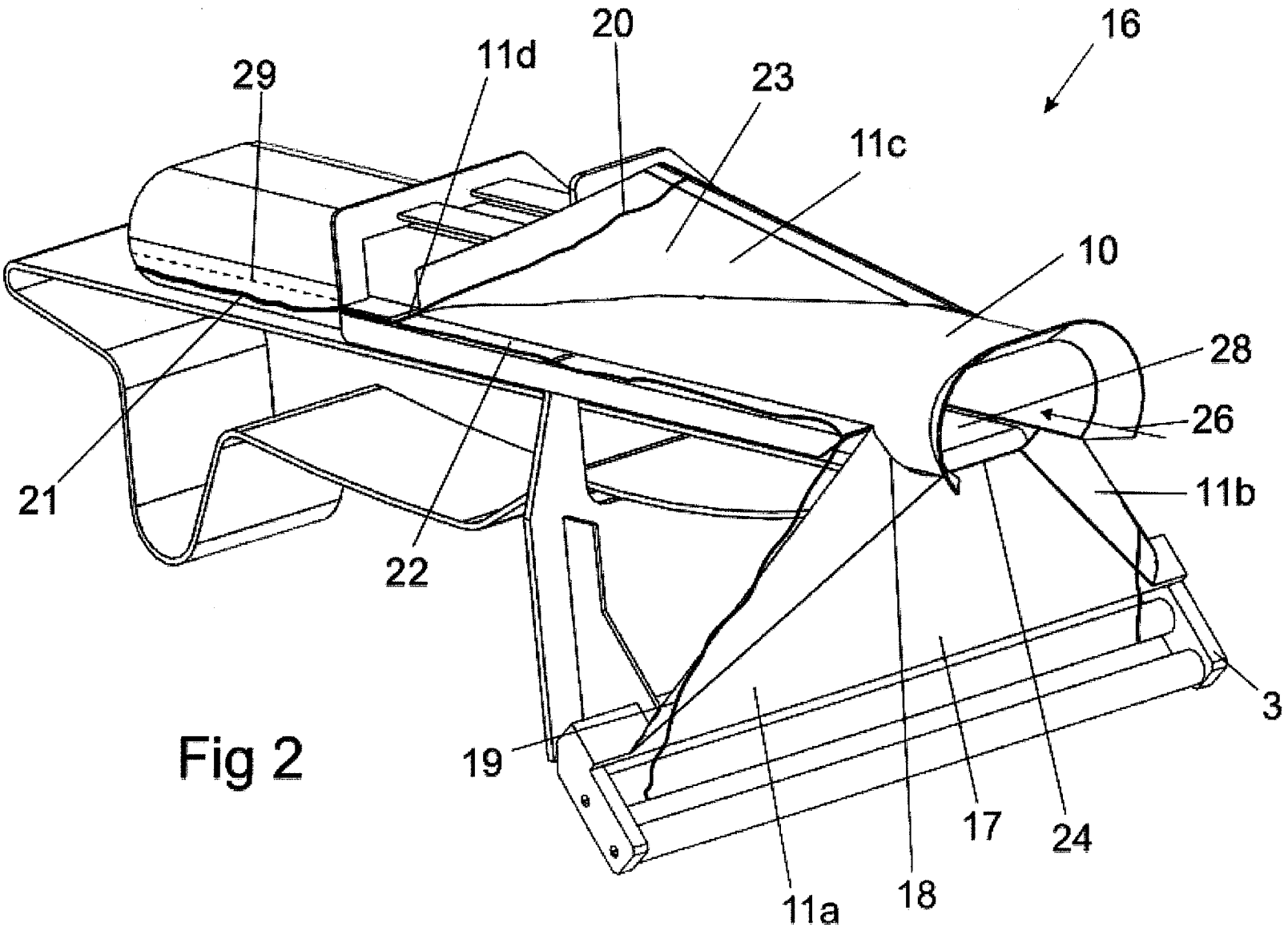
FIG. 2 is a close up perspective view from an engineering drawing, of the forming tube and forming shoulder of the apparatus of FIG. 1.
Figure 3A:
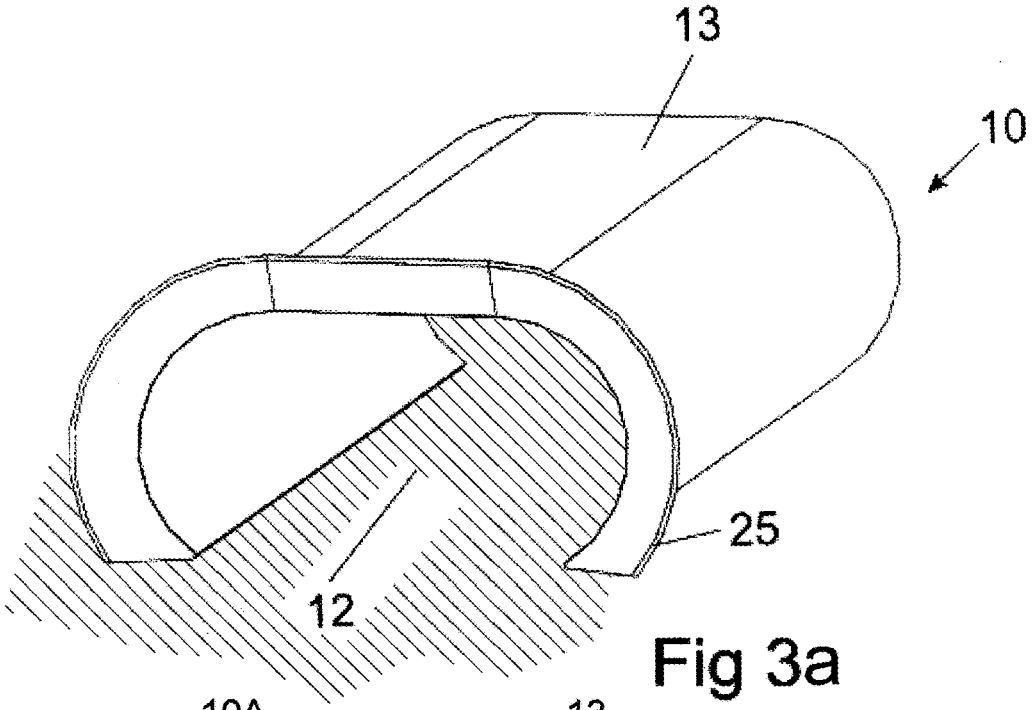
FIG. 3*a* is a perspective view of the forming tube of FIG. 2, shown in isolation.
Figure 3B:
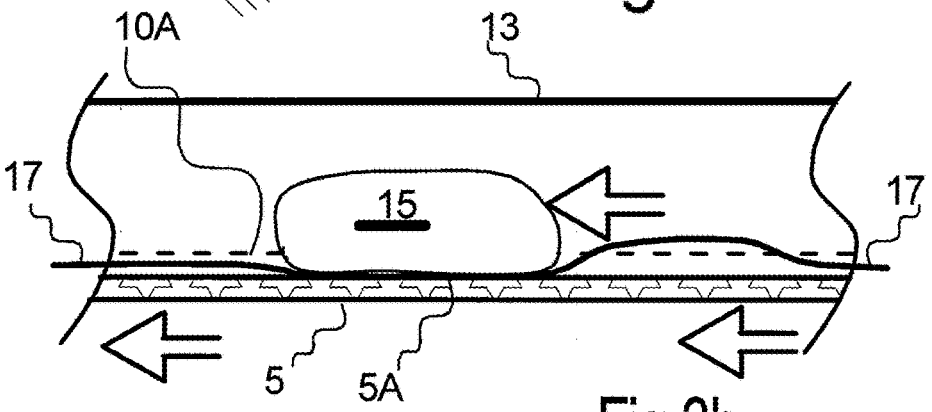
FIG. 3*b* is a side elevation view depicting the frictional linkage between the transit conveyor and items inside the forming tube.
Figure 4:
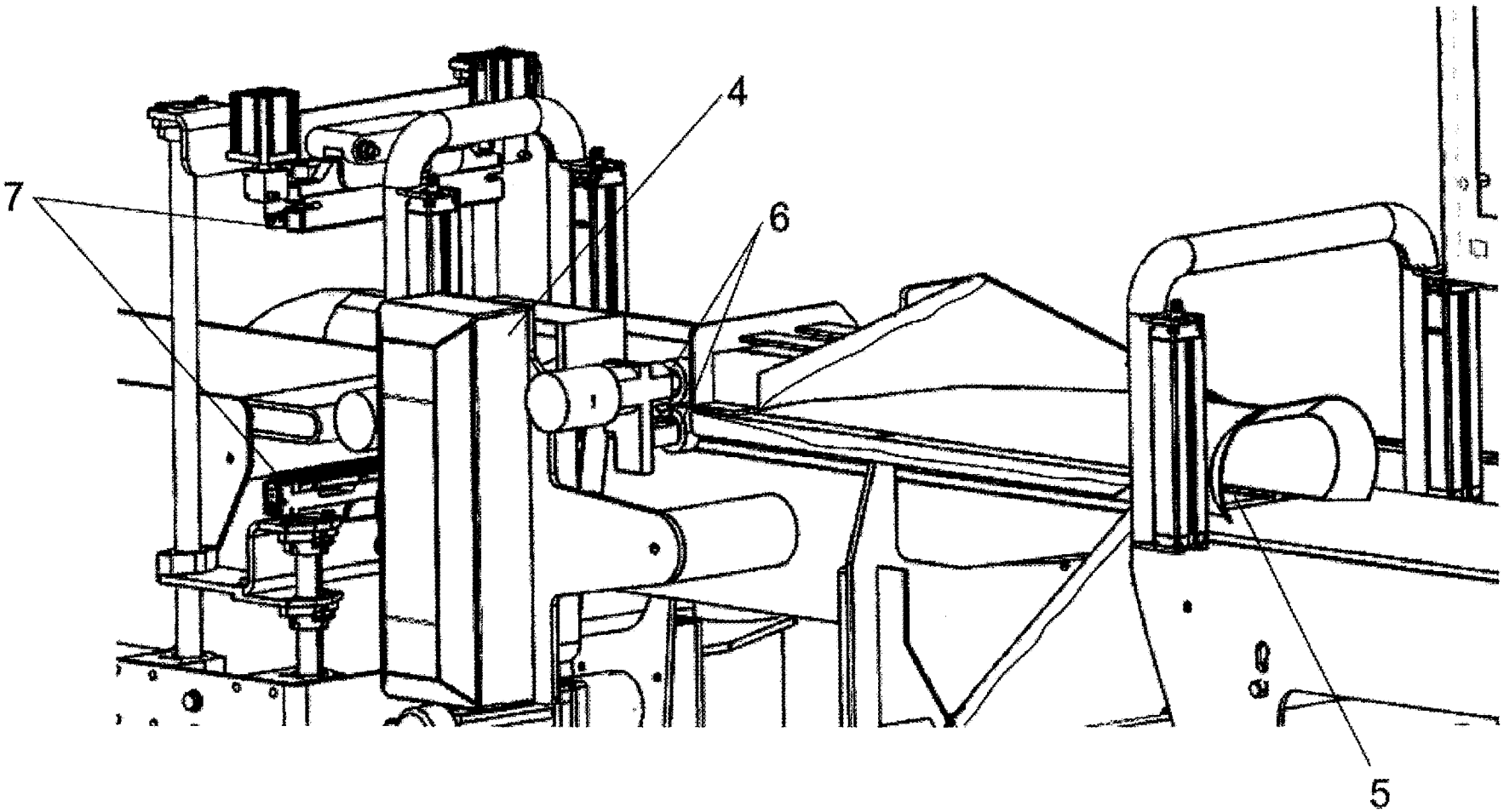
FIG. 4 is a close up perspective view of the apparatus of FIG. 2 showing the forming tube and sealing apparatus in more detail.

With particular reference to FIGS. 2-4, the bag forming process will be described in detail. Horizontal flow wrapper apparatus 16 includes film guide 3 for receiving film from the supply spool 2 beneath the axis of the forming tube. As is known to those skilled in the art, feed rollers or film guide 3 (not shown in FIG. 1) can be configured to maintain a constant tension in the film. Preferably the supply spool (not shown in FIG. 2) is turned by a servo-controlled motor. Note that the supply spool is offset from directly below the forming tube so that film intended for the upper side of the bag rises up beside the bag and over the forming shoulder. After passing through film guide 3 at about the same velocity as that of the contact surface of transit conveyor 5, film 17 is led onto and shaped around forming tube 10 by a specifically shaped forming shoulder 11 (see below) (often called a "plough" in the industry). The forming shoulder 11 delivers an upper and a lower part of the bag out of a left side and a right side of the supplied film, so that one longitudinal seam only is required. While the item to be bagged passes along the forming tube it becomes enveloped within the film, though as yet it is in contact with a lower part of the film only; arising from one side of the spool. The lower portion of the forming shoulder 11 provides a flow of film that will become the bottom portion of the pouch or bag.

The forming shoulder 11 includes a first underneath portion 11*a* that receives and guides a first lateral portion (adjacent a first film edge 19) of the film 17 through a gap between the bottom of the forming tube 10, and a portion 18 of forming shoulder 11. One side of the film is directed to appear under the items and enters through slot 12 over lip 24 of the forming shoulder 11 at or near the in-feed end of the forming tube, with an available free edge. (That slot is exaggerated in FIG. 1 as a gap between conveyor 9 and conveyor 5). An upper side of the film (which initially extended to the side of the forming shoulder as a result of spool positioning) is passed over part of the forming shoulder and slides over the top of the forming tube; the free edge becoming available for side-sealing the pouch during passage, while the lower side of the film 17 slides immediately beneath the forming tube.

The remaining portions of the forming shoulder 11 are designed to fold the film 17 along a median, and align both free edges of the supplied film together for sealing as the longitudinal seam 22 with 23, according to methods known to the skilled reader. To achieve this, region 11*b* of forming shoulder 11 begins to fold the film out of plane approximately at the mid portion of the film 17. Portion 11*c* of forming shoulder 11 is a continuation of portion 11*b* and brings the second film edge 20 back towards the first lateral edge 19, thereby forming a hollow tube wrapped around the forming tube 10, and presenting overlapping longitudinal free edges 22 and 23 ready for sealing together. (This section of the apparatus is indicated generally at 4). A partial gap 32 between the forming shoulder 11 and the forming tube 10 allows the film to pass between them and complete the formation of a tube of film. Portion 11*d* of the forming shoulder 11 completes the orientation by bringing the second edge 20 in horizontal alignment, so that it overlaps with the first edge 19. Thereafter, the overlapping seam region can be sealed with a longitudinal seal 21, thereby making a sealed tube. Sealing methods are described below. Both edges 22 and 23 of the film are illustrated in FIG. 2 as wavy lines, for clarity. It will be appreciated that in practice, these edges are preferably straight, and the film is taut. Alignment of free edges may be maintained by servo control of a separate motor drive for the drive wheels, so that both free edges are aligned for sealing. Conveniently the seam forming apparatus 4 is on the same side as the operator station.

One side of the film is directed to appear under the items and enters through slot 12 over lip 24 of the forming shoulder 11 at or near the in-feed end of the forming tube, with an available first free edge. An upper side of the film is taken to pass over part of the forming shoulder and to slide over the top of the forming tube, where the second free edge is ready for side-sealing the pouch during passage of items, while the lower side of the film 17 slides immediately beneath the forming tube. Slot 12 extending along the bottom of the forming tube 10 serves as an access port through which items, such as cuts of meat entering into the forming tube are accessible, through the film, to the contact surface of the transit conveyor 5, as shown in FIG. 3*b* as the conveyor carries the items through the forming tube 10 (along direction 26). The item to be bagged will become enveloped within the film, though as yet it is in contact with a lower part of the film only. The upper part is above the forming tube and in position to receive printed information.

The outer surface of the forming shoulder 11 is preferably dimpled or otherwise sculpted with a pattern of rounded domes so that the film can glide over the metal surface without becoming bound to the surface by condensation and resulting surface tension.

The forming tube 10 has no base. It is mounted 10A from a chassis or frame of the apparatus above and close to the inlet end (mounting not shown). The mount preferably is hinged from the chassis to allow opening of the interior for cleaning purposes. In this Example, forming tube 10 is elongated and is preferably symmetric about its long axis. The forming tube is disposed when in use in a substantially horizontal processing direction 26. The forming tube has an in-feed end and an out-feed end. The inlet end of forming tube 10 is shown in more detail in FIG. 3*a*. Preferably the in-feed end has an inlet flare 25 which helps to guide items 15 into the forming tube. One side is nearer to an operator station, along which side a seam is to be formed. The far side needs relatively little attention during use. The forming tube 10 of the invention has an internal space, an at least partially flat upper surface upper surface 13, and two sides. Notably there is no lower surface.

The cross-sectional shape of forming tube 10 preferably has curved side wall portions, and any transverse cross-section of the forming tube 10 resembles a letter "C" having a downwardly directed open side 12 and a flat surface opposite. The open side comprises a longitudinal slot extending the full length of the tube. The tube can be pivotally raised from the transit conveyor 5 and it can be exchanged for a different size of tube. As shown in FIG. 3*b* the forming tube lower border 10A does not contact and does not rest on the transit conveyor 5 beneath.

Larger, heavier items are normally packed with use of a correspondingly larger diameter forming tube 10 and vice-versa for economy in use of film. The forming tube is provided in a range of sizes. Since each forming tube and forming shoulder should conform in outer surface profile with each other, the term "a forming set" is used for each matched pair.

See FIG. 3*b*, a diagrammatic, sectional elevation view of part of the forming tube having a top surface 13 and aperture 12 below. The transit conveyor 5, through the film 17, supports an item 26 within the forming tube. The continuous aperture 12 allows a physical contact linkage to be maintained for the length of the forming tube between (a) an upper contact surface of the transit conveyor 5 beneath, (b) a lower surface of the film 17 while enveloping the forming tube and (c) each item 26 to be bagged.

That linkage is substantially maintained by static friction, in which the weight of the item 15 presses down on the film 17 and is supported by the upper contact surface of the transit conveyor 5, while moving from right to left as shown by the arrows. Corresponding horizontal motion of the film carries the item through the forming tube 10 in the direction of the arrows in FIG. 3*b*. There is some lateral component of force between the film and the contact surface indicated here as 5A, because a pulling force is applied to pull or drag the film over the forming shoulder and over the forming tube while being shaped into a folded shape ready for conversion into a tube by sealing. Slippage between the film and the contact surface is tolerable. Heavier items provide proportionally more pulling force for a larger sheet. In order to ensure that the free edges are maintained in line before entering a longitudinal sealing station, a servo drive may operate to pull exposed edges of the film along in step with motion of the transit conveyor 5. A further servo drive may be required on the far side of the forming tube from the edges. In practice there may be several items passing through the forming tube at any one time.

The horizontally disposed forming tube allows the lower side of the film to support each item in longitudinal orientation upon a fresh surface while being carried by the transit conveyor, which is driven through the flow wrapper apparatus at a constant speed. The weight of the item tends to hold the film against the contact surface of the transit conveyor 5 with static friction, tending to provide that the film and hence any items resting on the film is dragged through the forming tube at the same speed as that of the conveyor. As a result, motion of the item through the bagging apparatus is locked to motion of the film, as facilitated by the open lower side of the forming tube as shown in Fig. The motion of the transit conveyor 5 would be continuous and steady if the transverse sealer and cutter 7,7 (see below) moves with the motion of the film while making the cut and seal, or intermittent if a transverse cut is made by a cutter at a fixed position.

The outer surface of the forming tube 10 may also be partially dimpled or otherwise sculpted with a pattern of rounded domes so that during use the film can glide over the metal surface without becoming bound to the surface by condensation and resulting surface tension. External surfaces, like those of the accompanying forming shoulder, should be curved rather than include corners, in order to protect the sliding film.

Synchronised motion of the film and of the item or items to be packed, which is intended to be a result of static friction upon the contact surface of the transit conveyor 5, is supported by use of a "caterpillar" or drive belt or a series of driving wheels or pinch rollers to grip both free edges 22, 23 (corresponding to each side of the film coming off the supply spool) of the film after being folded over and brought against each other. The longitudinal sealing means is described with reference to FIG. 4. For sealing purposes presence of both edges at or about the position of longitudinal sealing head 4 is checked by optical or other transducers and maintained by servo drives. The two edges are pressed together and heated in order to cause fusion of the thermoplastics surfaces, using an energy input from an ultrasonic generator, or a heated roller, or other means as are well known to those skilled in the art. Servo-controlled motors 27 drive the wheels or rollers are used to keep the seam regions in step with the body of the bag while it is being transported, and avoid skewing. The longitudinal sealing head 4 is provided between pinch roller sets 6, in order to seal overlapping seam regions 22, 23 together. Preferably the longitudinal sealing head is an ultrasonic sealer. Alternative longitudinal sealing heads may be of any other type known to those skilled in the art, such as a heated wheel or roller, or a combination of rollers and hot air jets.

It will be appreciated that as the meat cuts or other items pass through the forming tube 10, the film 17 becomes wrapped around the outside of the forming tube 10 to form a continuous tubular bag. At the out-feed end of the forming tube, the bag and the item come into full and final contact. By the time the meat cut or other item exits the forming tube 10, the longitudinal side seam seal has been completed and has cooled, and cannot be affected by subsequent contamination from the meat cut.

Usefully, the overlapping seam region (22, 23) may be positioned close alongside the forming tube 10. Unlike the prior art, no safety margin is required in case of inadvertent liquid contamination because the side wall portion of the forming tube is between the seam region and the inside of the tube. The seam region is always protected from contamination from particular items expected to leak fluids, such as cuts of meat which are a major application for the present invention. Bringing the longitudinal seam seal closer to the meat cut yet retaining seal integrity allows relatively large pieces of meat (relative to the current film spool width) to be sealed. Preferably, the sealing position is separated from the contact surface of the horizontal conveyor. It may be raised slightly in order to prevent meat juices or other contamination entering the overlapping edges 22, 23 from the conveyor surface. Preferably it is approximately at, or above a midway point with respect to the height of the forming tube 10.

One transverse seal is also constructed for each bag. (During a subsequent evacuation process a second and completing seal is made). The transverse sealer 7 (indicated schematically in FIG. 1 as two heated bars 7 and 7) is situated downstream from the longitudinal seal head and beyond the outlet end of the forming tube. At that place, each item within its region of the as yet unbroken tube of film has parted from the forming tube. The transverse seal is made either upstream, or downstream of an item within the film tube according to an operational decision. The preferred transverse sealer 7 includes upper and lower controllably heated bars that are held wide apart and can be brought together at a desired moment under process control to press together and fuse the upper and lower walls of the film by softening or melting the film, thereby forming a transverse seal across the tube. The desired moment is typically set by previously detected item length, using optical or other sensors at a preceding position along the tube. An ultrasonic tube heater, or an instantaneously heated surface could be used, but internally heated bars maintained at an appropriate temperature are cheaper and also transfer the clamping force.

The transverse sealer 7 preferably also includes a transversely operable knife to be located parallel to the sealing area and is pushed through the bag alongside the seal. In a version that produces a completely sealed line for a bag on one side of a cut line, and a tacked seal on another side of the cut line, the knife is adjacent the complete seal is as previously described; and a further discretely heated sealing bar set is on the other side; intended to "spot-weld" the edges together so that during subsequent complete sealing inside the vacuum assembly the two film surfaces to be sealed together are already correctly placed yet air can be pulled from within the bag during evacuation. The transverse sealer 7 is preferably movably supported on bars and is capable of being driven to and fro along the axis of the forming tube by a linear motor, servo-controlled when sealing to match the motion of the transit conveyor when carrying out bag sealing and bag cutting. The linear motor could be a multi-pole DC motor or simply a belt drive, driven by a rotary motor. The transverse sealing bars are moved apart to allow the next item to pass.

If the transverse sealer 7 is immovable, the transit conveyor would be stopped when transverse sealing is in operation.

Figure 6A:
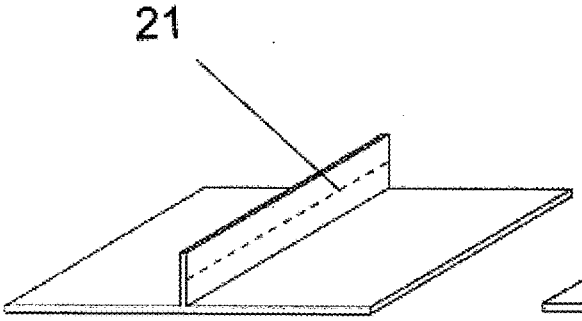
PRIOR ART Fig 6a
FIG. 6*a* is a schematic view of a folded bag of the prior art, shown before transverse sealing.
Figure 6B:
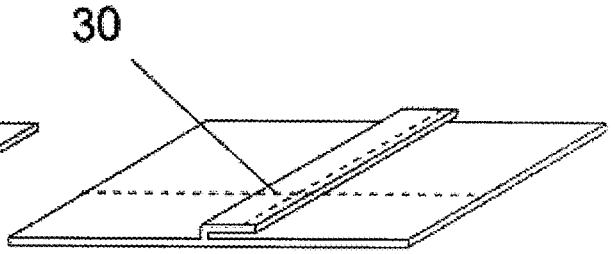
PRIOR ART Fig 6b
FIG. 6*b* is a schematic view of the prior art folded bag of FIG. 6*a*, shown after transverse sealing.

An advantage of siting the longitudinal seal 21 on the side of the film tube, and also of forming the transverse seal in or about the same plane as the longitudinal seal is that the transverse seals are formed only through the two layers of film at the region where the longitudinal and transverse seals intersect. In the prior art (see FIGS. 6*a* and 6*b*), the median seal comprised two abutting films, sealed and laid over. Where the transverse seal crossed the earlier-made median seal, the extra thickness detracts from sealing quality since there are twice as many layers of film to be heated to a fusing temperature and pressed together, and it is not easy to maintain sealing conditions that work well for either number of layers. A reliable seal reduces the possibility for capillary leakage to occur over time.

Bag printing is intended to record product description. At least some information is on an item-by-item basis. As shown particularly in FIG. 3, the forming tube 10 is provided with a relatively flat central upper region 13 herein described as a platen. The large available surface of the platen facilitates customised bag printing such as by a computer-driven print head which uses the platen as a backing surface behind the film. A form of ink-jet printing is generally used to print on the film. Preferred inks are selected for durability when applied to the outside layer of the film, especially when at chilled temperatures. In the prior art, printing was usually done before the film enveloped the items. An advantage of placing the platen at this site is that the printed indicia can be more easily linked to the contents since printing is done in step with transport of items. Steady movement of the film over the platen provides a useful motion under the print heads. As illustrated in FIG. 1, a print head support 8 directly above the forming tube 10 holds the print head (not shown) in a position to print against the platen 13. The support can be hinged back off the apparatus frame for print head maintenance, for cleaning, or when threading a new spool of film through the bagger.

Printing directly over the instantaneous location of the item reduces any possibility of tampering or error. In particular, it will be appreciated that the item is deep within the forming tube 10 at the time of printing and is for all intents and purposes, inaccessible from the outside. Items emerging from the outlet of the forming tube 10 are located beneath the correct indicia.

The flow wrapper apparatus is preferably provided with one or more electronic sensors 31 and associated servo controls. Monitoring is useful for detecting and registering the size, mass, consistency, appearance, and/or position on the in-feed conveyor of the items to be packed, and to monitor and respond to operating conditions such as blockages, items in contact with each other, dangerous operator hand placement, film tears, improper longitudinal and transverse sealing, coordination of film velocity with contact surface velocity, and failures to convey items at a correct speed. For example, optical sensors selected from a range including video cameras, linear scanning devices, and curtains made of a series of interruptible beams may be used to detect and measure items as they move along in-feed conveyor 9 and enter forming tube 10. In relation to the forming tube, the seam transport drive is synchronised with transit conveyor motion using encoder and variable-speed motors as known to those skilled in the control systems arts, and sensors of free edge position may be coupled to the seam transport drive in order to minimise skewed film motion.

Item-specific information which may be derived in real time from sensors can direct a process computer (not shown) to generate appropriate print head instructions to cause printing of item-specific or other information in line with the position of the item. Item-specific information such as item length is used to time the action of a transverse sealer 7 so that it seals the tube along an intended line in between one item and the next. Length-responsive detectors 31 (detecting an interrupted beam, in combination with conveyor velocity sensors (not shown) and measurement of interruption time of, calculated to provide item length) may be used to vary the length of the pouch formed by the machine according to the size of the meat cut. Optimising bag length ensures that film is not wasted. Item-specific information may also be used for broader management purposes including tracking the position of specific items, each one of which may have a known origin, as they pass through a bagging sequence, are packed into containers, and are shipped.

VARIATIONS

In a meat processing plant, for example, the meat cuts are often sorted by size (diameter) before bagging. One bagging machine may be set up with a relatively small forming tunnel 10 and corresponding forming shoulder, and a narrower spool of film to economically place selected items into small-diameter bags, while another bagging machine is operated at the same time with a larger forming tunnel, and a wider spool of film in order to pack larger items.

As previously mentioned, a range of forming tube diameters is provided, in sizes ranging between approximately 150 and approximately 650 mm (in 50 mm steps). Each size actually refers to a bag width; for example a 250 mm label means that the forming tube accepts a 500 mm width film and folds it in order to create an about 250 mm wide (if empty) bag to encompass an about 150-155 mm diameter item. Each size of forming tube is a set with an accompanying forming shoulder having matched surface profiles.

An option is to have make a right-to-left and a left-to-right version of the apparatus (with reference to FIG. 1). In some installations, the natural flow of items already has a specific direction and the flow wrapper should comply. Or, one machine of each version can be run back-to-back beside each other inside a space, for a smaller total footprint. Relevant to that is that this machine has a relatively small footprint.

ADVANTAGES

The present apparatus has been found to provide a significant improvement in vacuum packaging apparatus and methods, by providing a horizontal continuous flow wrapping and forming process utilising a side seam. For example:

1. Simplicity of design around the forming tube.
2. Ease of cleaning the forming tube, when raised.
3. Ease of dismounting and replacing the forming tube and shoulder
4. Seals are along pack side edges, not down the midline
5. Seals (particularly the side longitudinal seal) may be created closer to the nearest part of the meat cut, thereby reducing waste, since the forming tube intervenes.
6. Seals do not involve intermittently included 4-ply seals as in the prior art.
7. A wide printing space, uninterrupted by longitudinal seals, is available upon the flat platen.
8. Fresh film supports each item while it moves through the forming tube. Contamination is unlikely.
9. The film is moved in step with the contact surface of the transit conveyor making use of item weight, transferred through the open lower surface of the forming tube.
10. The caterpillar mechanism for drawing the film along by its free edges is servo-controlled to maintain presentation of the two free edges for sealing them together.
11. Measurement of incoming items provides bag length data, and contributes to product type data for immediate printing, so that a bag can be custom-printed and then cut to a custom length.

Finally it will be understood that the scope of this invention as described and/or illustrated herein is not limited to the specified embodiments. Those of skill will appreciate that various modifications, additions, known equivalents, and substitutions are possible without departing from the scope and spirit of the invention as set forth in the following claims.

We claim:

1. A flow wrapper apparatus comprising:

a horizontally disposed forming tube and a forming shoulder that use a continuous length of a plastic film having a first side and a second side, the forming tube having non-adjustable dimensions and a length, a near side with respect to a position of an operator, a far side with respect to the operator position, an in-feed end, an internal space, and an out-feed end, the forming tube having a continuous upper surface including a flattened surface configured to be used as a printing platen by a printing device, wherein the flow wrapper apparatus is configured to separately wrap or bag items that are cuts of meat including fish or poultry meat, and uniquely label each of the wrapped items of a series of items received from an adjacent in-feed conveyor to separately identify each of the wrapped items with indicia.

2. The flow wrapper apparatus as claimed in claim 1, wherein a lower part of the horizontally disposed forming tube defines a downwardly disposed, broad, continuous, elongated slot, the flow wrapper apparatus further comprising a forming tube support maintaining the forming tube at a height above an endless transit conveyor, the forming tube support being pivotally mounted from at least one hinged mount fixed to a frame of the flow wrapper apparatus adjacent the far side of the forming tube.

3. The flow wrapper apparatus as claimed in claim 2, wherein, when in use, a first side of the continuous length of the plastic film slidably encloses the elongated slot of the forming tube while supporting each of the series of items inside the forming tube upon a separate, freshly exposed area of the plastic film in static frictional connection upon a moving carrying surface of the endless transit conveyor that includes a first film transport device for which the film is moved at a controlled speed over the forming shoulder, along the length of the forming tube, the controlled speed being the speed of the series of items on the endless transit conveyor.

4. The flow wrapper apparatus as claimed in claim 3, wherein, when in use, a second side of the continuous length of the plastic film slides at the controlled speed over the upper side of the forming tube, including the printing platen and beneath a printing device where the film is configured to receive printed indicia relating to an adjacent item of the series of items such that each of the items after being wrapped carries corresponding printed indicia.

5. The flow wrapper apparatus as claimed in claim 4, wherein, when in use, a first free edge of the plastic film of the first side is aligned with and maintained adjacent a second free edge of the plastic film of the second side, both of the first and second free edges being maintained along and outside the near side of the forming tube.

6. The flow wrapper apparatus as claimed in claim 5, further comprising a second film transport device located along the near side of the forming tube and about a film sealing device, the second film transport device comprising a gripping set of transport devices selected from one or more of pinch wheels, pinch rollers, and pinch belts in order to grip the first and second free edges of the film outside the near side of the forming tube, the gripping set of transport devices being driven by a servo-motor in step with motion of the first side of the plastic film, the second film transport device maintaining movement of the gripped film at the controlled speed, the film sealing device being selected from one or more of heated wheels, heated rollers, ultrasonic sealers, and hot gas, the film sealing device sealing together the two free edges of the film when adjacent, thereby making a longitudinal seal at the controlled speed.

7. The flow wrapper apparatus as claimed in claim 6, wherein the flow wrapper apparatus is controlled by a process computer that is provided with inputs from sensors that are configured, when in use, to monitor a supply of items to be bagged and to derive a length of each item while in transit upon the endless transit conveyor, the process computer being configured to perform commands to be sent to the printing device and to control timing of an operation of a transversely disposed bag sealing device so that each of the items is enclosed within the film and is labelled with related indicia that are printed onto the film.

8. The flow wrapper apparatus as claimed in claim 1, wherein the machine is manufactured in order to operate in either a left-to-right operating mode, or in a right-to-left operating mode, with reference to the operator position.

* * * * *